United States Patent [19]

Jonelis

[11] Patent Number: 4,519,818

[45] Date of Patent: May 28, 1985

[54] ELECTROSTATIC PRECIPITATOR CONSTRUCTION HAVING MOVABLE SPACERS

[76] Inventor: John A. Jonelis, 304 Lancaster Dr., Crystal Lake, Ill. 60014

[21] Appl. No.: 637,431

[22] Filed: Aug. 3, 1984

Related U.S. Application Data

[63] Continuation-in-part of Ser. No. 446,775, Dec. 3, 1982, Pat. No. 4,478,614.

[51] Int. Cl.[3] ..... B03C 3/08; B03C 3/47

[52] U.S. Cl. ..... 55/130; 55/137; 55/145; 55/154

[58] Field of Search ..... 55/109, 112, 130, 137, 55/143, 145, 149, 154

[56] References Cited

U.S. PATENT DOCUMENTS

| | | | |
|---|---|---|---|
| 2,036,323 | 4/1936 | Engert | 55/109 |
| 2,271,597 | 2/1942 | Lodge | 55/130 |
| 2,884,087 | 4/1959 | Matts | 55/149 X |
| 3,125,426 | 3/1964 | Herber et al. | 55/130 |
| 3,530,645 | 9/1970 | De Lisio | 55/130 X |
| 4,007,023 | 2/1977 | Batza et al. | 55/143 X |

*Primary Examiner*—Kathleen J. Prunner
*Attorney, Agent, or Firm*—Anthony S. Zummer

[57] ABSTRACT

The present invention relates to an improved construction for an electrostatic precipitator. An electrostatic precipitator collects solid particles carried by a flue gas from a source of combustion. The precipitator includes a plurality of spaced parallel plates for collecting solid particles from a flue gas by electrostatic attraction of the solid particles to the plates. A second plurality of elongated electrodes is positioned among the plates. Each of the electrodes is mounted between a pair of adjacent plates. A third plurality of identical spacers is positioned between adjacent plates. The spacers are pivotally mounted on each of one of a pair of adjacent plates. The spacers are positioned substantially parallel to the respective plate so that the plates may be handled with ease during installation. Upon completion of installation of the plates, the spacers are moved to and locked in an attitude substantially perpendicular to the plate and in abutment to the adjacent plate to hold the plates in a flat attitude and to maintain adjacent surfaces of adjacent plates equidistantly spaced from one another.

20 Claims, 8 Drawing Figures

ELECTROSTATIC PRECIPITATOR CONSTRUCTION HAVING MOVABLE SPACERS

CROSS-REFERENCE TO RELATED APPLICATION

This application is a continuation-in-part of patent application Ser. No. 446,775, filed Dec. 3, 1982, entitled, "Electrostatic Precipitator Construction Having Spacers" now issued as U.S. Pat. No. 4,478,614, on Oct. 23, 1984.

BACKGROUND OF THE INVENTION

A commonly accepted practice of removing solid particles from a flue gas includes the utilization of an electrostatic precipitator to attract and hold the solid particles without inhibiting the flow of the flue gas. Typically, an electrostatic precipitator is positioned in a flue between the outlet of a boiler and a smokestack.

The ordinary construction of an electrostatic precipitator includes a plurality of large flat metal plates which are spaced from each other. The metal plates may have a height of 30 feet or more and a width of 10 feet or more. The specific size of the plates in a given precipitator is dependent upon the given precipitator construction for a given application. Ideally, the flat plates are equidistantly spaced from each other. A second plurality of elongated electrodes is positioned among the plates. The electrodes are positioned between each pair of adjacent plates. The elongated electrodes are equidistantly spaced from adjacent plates.

The uniform spacing of the elongated electrodes from the plates is necessary to have a uniform electrostatic charge between the elongated electrodes and the plates. A uniform electrostatic charge generates uniform collection of solid particles on the plates. The solid particles are typically removed from the plates by rapping the plates to vibrate the plates and thereby cause the solid particles to drop off of the plates in clusters into collectors under the plates.

The flue gas which enters the electrostatic precipitator is hot. Commonly, there are fires caused by problems in the operation of the boiler. The heat causes the plates to warp and buckle. The warping or buckling of the plates destroys the uniform spacing between adjacent surfaces of adjacent plates and the uniform spacing between each of the elongated electrodes and respective adjacent plates. The effectiveness of the precipitator in removing solid particles from flue gas is reduced so that the precipitator has a lower capacity. Consequently, the capacity of the boiler, which produces the flue gas must also be lowered to comply with emissions regulations. In the case of a power generation unit, as the capacity of the boiler is reduced, the capacity of the power generating system connected to the boiler is also reduced. In order to maintain an electrostatic precipitator fully effective, it is desirable to maintain the spaced plates of the precipitator in an equidistantly spaced relationship to each other and to the electrodes.

One apparatus for holding electrostatic precipitator plates in an equidistantly spaced relationship is taught in U.S. Pat. No. 4,007,023, issued Feb. 8, 1977, to Batza et al, entitled, "Electrostatic Precipitator With Collector-Electrode Spacers". The Batza et al patent discloses a spacer construction for use between adjacent collecting electrode strips to hold the strips apart an equal distance from each other. Each spacer includes a bracket which is fixed to one of the strips. A spacer body is connected to the bracket by a pivot. A second bracket is fixed to a second electrode strip. The spacer body includes a slot for receiving the second bracket. The Batza device is expensive to manufacture and difficult to install since two brackets must be perfectly aligned on facing surfaces. The Batza et al device, in installation, requires that the Batza body have its slot fall onto the bracket of the opposing plate so that it is necessary for an installer to climb between the plates to make certain that each of the spacers is locked into the bracket of the adjacent plate. If the position of the second bracket is not perfect, then the spacer may pull the bracket in toward the adjacent plate and thereby create warping of the plate.

SUMMARY OF THE INVENTION

The subject matter of this invention is an improvement in the construction of an electrostatic precipitator for collecting solid particles from a flue gas, which flue gas originates at a source of combustion. The precipitator includes a plurality of spaced parallel plates for collecting solid particles by electrostatic attraction of the solid particles to the plates. A second plurality of elongated electrodes is mounted between adjacent plates. Each of the elongated electrodes is parallel to the other electrodes and to the plates. A third plurality of identical spacers is positioned between adjacent plates to hold the plates in a flat attitude and to maintain adjacent surfaces of the plates equidistantly spaced from one another. Each of the spacers is pivotally supported or mounted on one plate of a pair of adjacent plates. The spacer is positionable adjacent to its supporting plate and may be selectively pivoted to a position where the spacer is substantially perpendicular to the support plate. When the spacer is in the attitude wherein it is perpendicular to the support plate, it abuts the adjacent surface of the adjacent plate to maintain the plates in a selected spacial relationship.

DESCRIPTION OF THE PREFERRED EMBODIMENT

Figure 1:
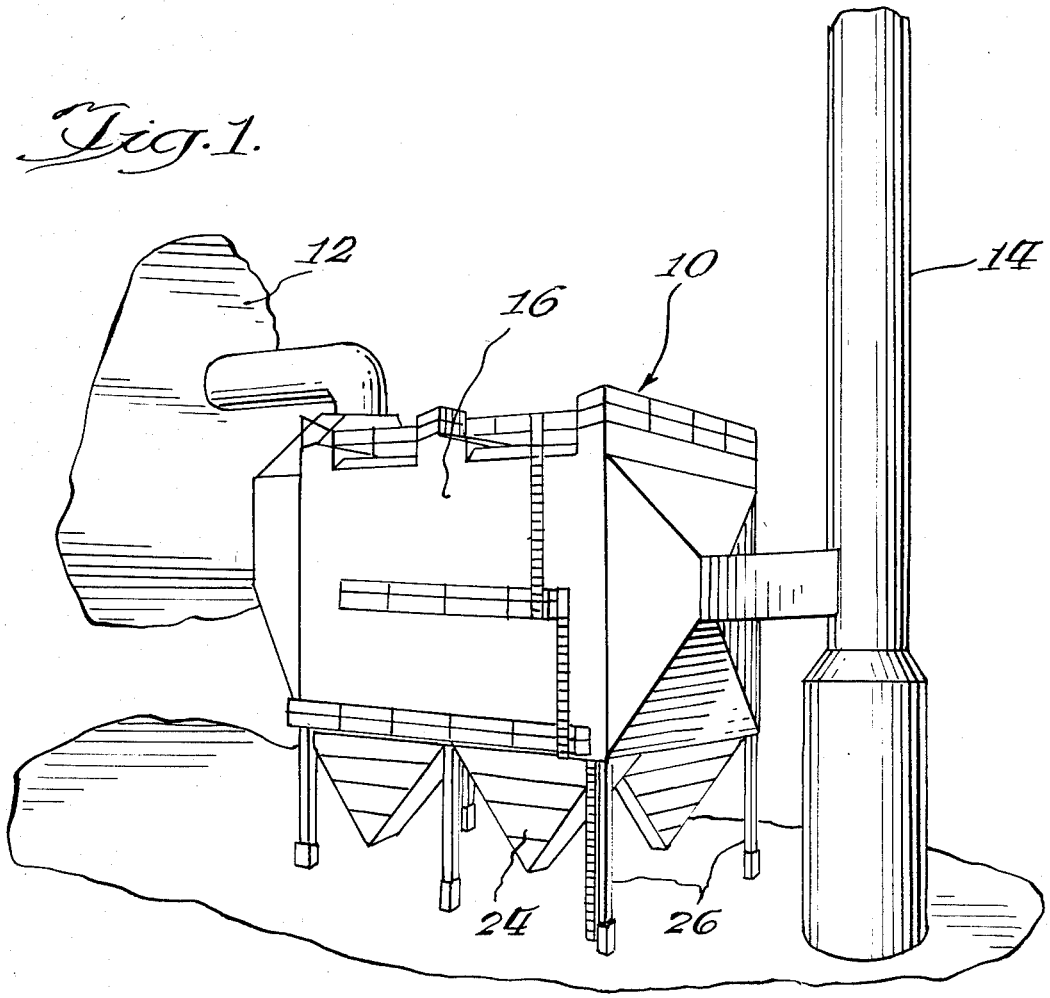
FIG. 1 is a perspective view of an electrostatic precipitator embodying the herein described invention positioned between a boiler and a smokestack.

Referring now to the drawings and especially to FIG. 1, an electrostatic precipitator embodying the herein disclosed invention is generally indicated by numeral 10. Precipitator 10 is mounted in a flue between a conventional boiler 12 and a conventional smokestack 14.

Figure 2:
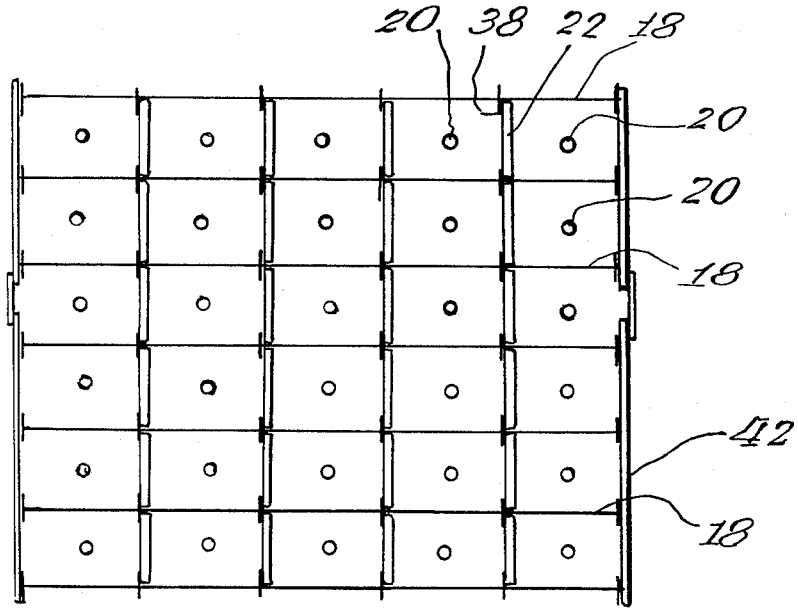
FIG. 2 is a plan view of a portion of the precipitator with walls and supports removed showing the relative position of plates and elongated electrodes with spacers between adjacent plates.

The precipitator includes a housing 16. A plurality of plates 18, as shown in FIG. 2, is mounted in the housing. A second plurality of elongated electrodes 20 is positioned between the plates. A third plurality of spacers 22 is mounted on plates 18 to maintain the plates in a uniform spaced relationship and to flatten those plates which tend to warp or buckle.

Electrodes 20 and plates 18 are connected to a conventional source of an electrostatic charge which is not shown herein. As is well known in the art, the source of the electrostatic charge creates an electrostatic charge on the electrodes and an opposite electrostatic charge on the plates so that solid particles carried by a flue gas are charged by the electrodes and are attracted to plates 18. As is conventional, cleansed flue gas then flows to smokestack 14.

The construction of the electrostatic precipitator is conventional in that the electrostatic precipitator housing 16 has its inlet connected to boiler 12. The housing has its outlet connected to smokestack 14. The bottom of housing 16 includes a plurality of conventional hoppers 24, which are adapted to receive the solid particles which are collected on the plates. The hoppers may be selectively opened at their respective bottoms to discharge from the housing the collected solid particles. Housing 16 includes a plurality of legs 26 to support the precipitator. A high tension frame 28 is mounted in housing 16. Frame 28 is conventional in its construction and is connected to the source of the electrostatic charge. The elongated electrodes are conventionally mounted on frame 28.

Each of the electrodes 20 is a single metallic electrically conductive wire 30 with a weight 32 secured to the end of the wire to hold the wire taut and perfectly perpendicular to the horizontal. Since each of the electrodes 20 is held taut by its respective weight, all of the electrodes are parallel to each other. A lower high tension frame (not shown) restrains the wire weight in place to prevent movement. This frame is conventional in its design.

The precipitator includes a plurality of plate support rails 34, commonly known as anvil beams, mounted within housing 16. Plates 18 are conventionally mounted between adjacent rails 34. Each plate includes a metallic electrically conductive surface 36 with a plurality of stiffeners 38 formed on the plate to make the plate rigid. The stiffeners are perpendicular to the conductive surface as may be seen in FIG. 5. The stiffeners are spatially arranged and the length of each stiffener is perpendicular to the horizontal. A plurality of side spacer bars 40 is secured to the ends of the plates to hold the plates in a selected spaced relationship relative to each other.

As may be seem in FIG. 2, the plates are equidistantly spaced from each other with a plurality of electrodes positioned between a pair of adjacent plates. The electrodes are equidistantly spaced between the plates.

Heretofore, in a new installation, the plates and electrodes are equidistantly and regularly spaced as shown in FIG. 2. It has been found, that after some usage of the precipitator, the plates tend to warp and buckle and the weight of the plates do not hold the plates flat. The resulting variance in the distance between adjacent plates and electrodes reduces the effectiveness of the precipitator. In order to bring the precipitator back to its original effectiveness, spacers are added between adjacent surfaces of adjacent plates to equalize the distance between adjacent surfaces of adjacent plates. Recognizing that it is desirable to have the spacers even in a new installation to overcome the warping and buckling which occurs as a result of usage, spacers are added to the plates. The conventional method of adding the spacers to the plates is to weld each of the spacers to the plate in an attitude perpendicular to the plate. Since the distance between plates is approximately nine inches, this means that the plates must be fabricated with a plurality of nine inch protrusions extending from the plates. In transporting the plates, it is difficult to handle the plates and, of course, it is difficult to make certain that none of the spacers are damaged in transport.

Figure 7:
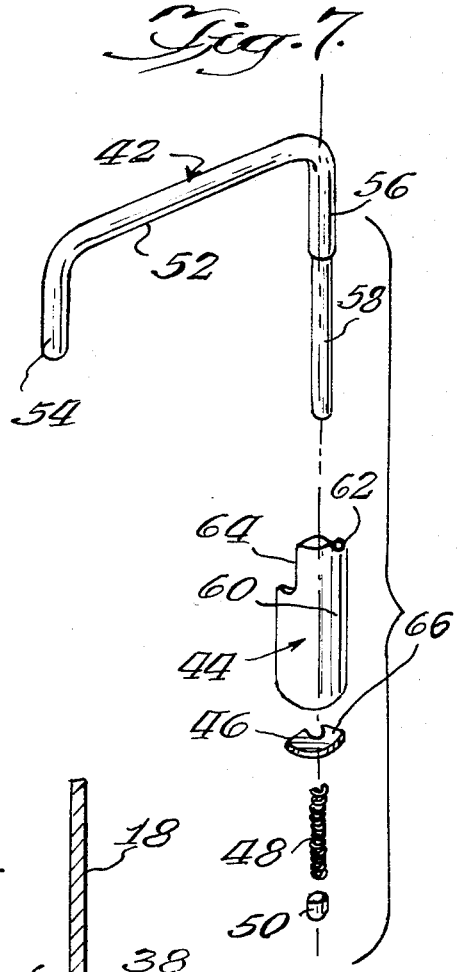
FIG. 7 is an exploded view of a spacer and parts for holding the spacer in a selected attitude.
Figure 8:
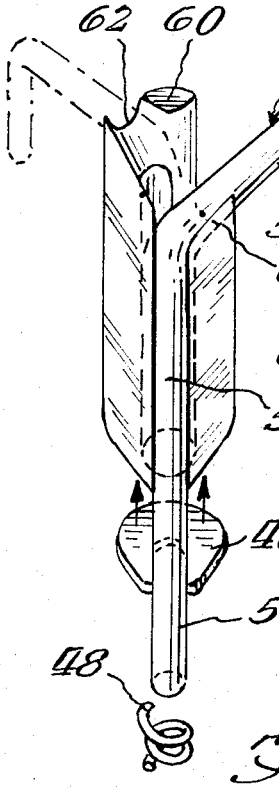
FIG. 8 is an enlarged fragmentary perspective view showing the spacer in dotted form in its rest position, and in full view in its attitude for abutting an adjacent plate.

The subject invention mounts the spacers on the plates with the spacers being positioned in an attitude where the spacers are substantially parallel to the plates. Once the plates are hung in the precipitator, the spacers are easily rotated 90° to an attitude where the spacers are locked in an attitude perpendicular to the support plate and in abutment with an adjacent plate so that the precipitator plates are held against buckling or warping. Each of the spacers 22, as may be best seen in FIG. 7, includes; a spacer unit 42, a holder 44, a seat 46, a coil spring 48, and a stop 50.

The spacer unit 42 is a unitary metal bar having a circular cross section and includes an elongated body 52 having an abutment head 54 formed integral with one end. At the other end of body 52 there is a support end 56 with a tail 58 formed integral therewith and extending downward from support end 56.

Holder 44 includes a quarter-round holder body 60 which rotatably receives support end 56. Body 60 has a retention notch 62 adjacent to one edge and a lock notch 64 adjacent to the opposite edge for receiving elongated body 52 to hold the spacer unit in an attitude perpendicular to its support plate.

Figure 6:
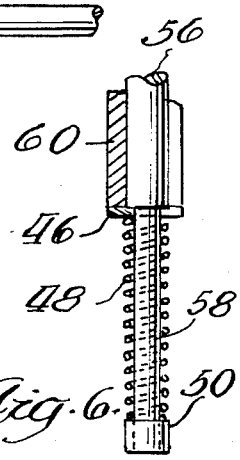
FIG. 6 is an enlarged cross sectional view of a portion of a spacer taken on line 6—6 of FIG. 5 showing the relationship of a spring for holding the spacer in a locked attitude when the spacer is perpendicular to its support plate.

Seat 46 is fixed to the bottom of body 60. Seat 46 includes a tail aperture 66 which allows tail 58 to pass through the tail aperture and move therein. Stop 50 is fixed to the end of tail 58. Coil spring 48 is mounted on tail 58 with one end engaging seat 46 and the other end engaging stop 50, as may be best seen in FIG. 6. The spring, in engagement with stop 50, tends to pull the spacer unit toward holder body 60 to hold the elongated body of the spacer unit in contact with the holder body. Thus, the spring and notch provide a lock to hold the spacer perpendicular to the support plate.

Figure 5:
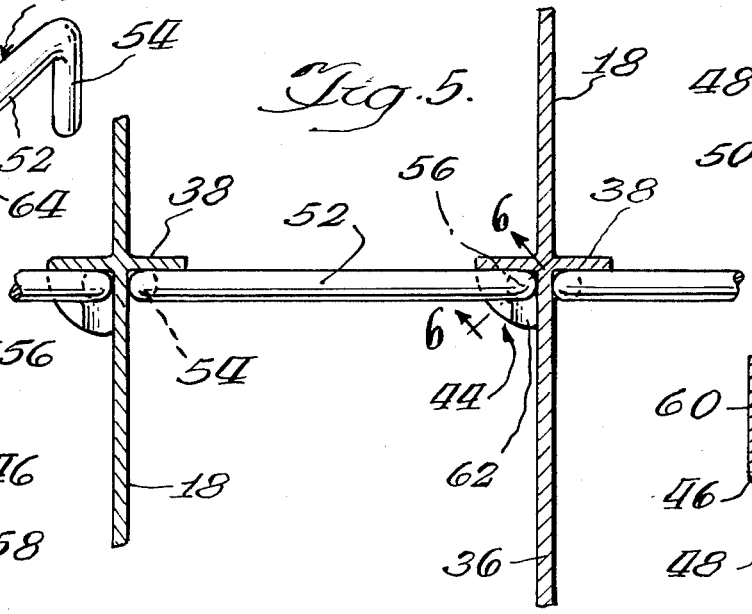
FIG. 5 is an enlarged cross sectional view taken on line 5—5 of FIG. 4.

As may be best seen in FIG. 5, each spacer is mounted on a support plate with holder 44 adjacent to a stiffener 38. Support end 56 of the spacer unit is rotatable in the holder; however, spring 48 provides a resilient means for pulling the spacer unit down toward the holder.

When the plates 18 are constructed with the stiffeners, the spacers are secured to the plates at selected intervals. The spacer units are arranged so that the spacer units are substantially parallel to the surface of the plate and the spacer body rests in retaining notch 62.

Figure 3:
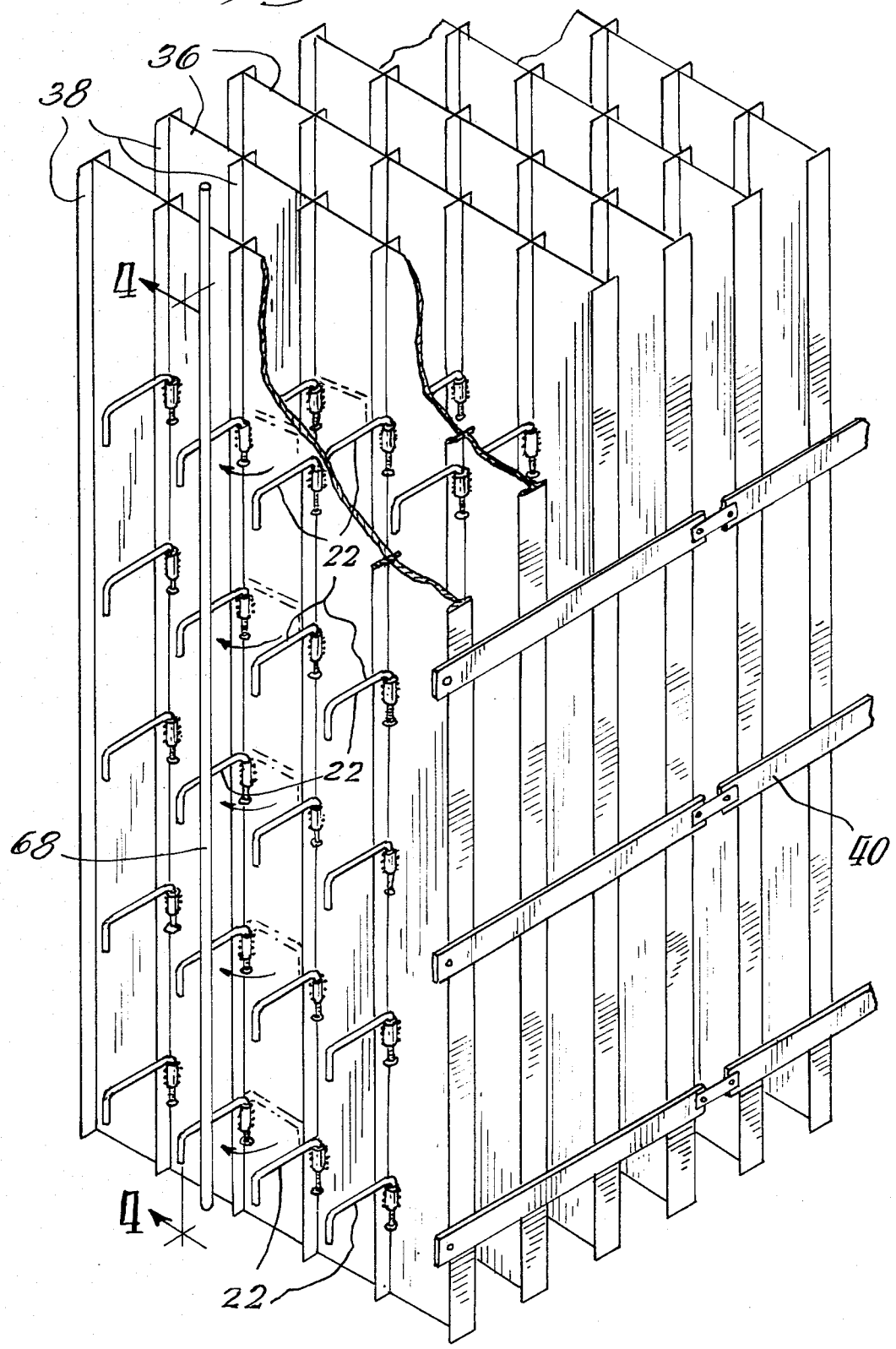
FIG. 3 is an enlarged fragmentary broken-away perspective view of the electrostatic precipitator shown in FIGS. 1 and 2 showing a plurality of spaced plates and spacers attached to certain of the plates to maintain plates in a uniform spaced relationship.
Figure 4:
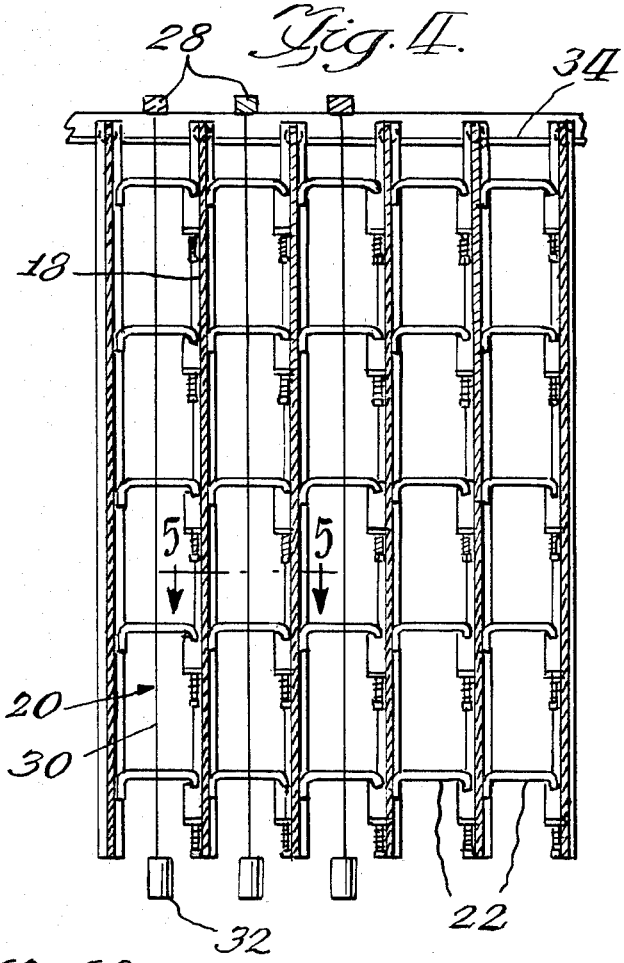
FIG. 4 is a cross sectional view taken on line 4—4 of FIG. 3 showing a side elevational view of a plurality of plates showing spacers embodying the present invention in an attitude for holding the plates in a spaced relationship.

Thus, the plates may be fabricated with the spacers on the plates and conveniently handled and shipped from the point of fabrication to the precipitator installation. The plates are hung in a conventional manner. Once the plates are hung, the spacers may be extended, as shown in FIG. 3. A long pole, such as pole 68, is positioned in between a pair of adjacent plates, and the spacer units then may be pivoted in the holders so that the elongated body of the spacer unit is moved from an attitude wherein it is parallel to the support plate, to an attitude in which the elongated body is perpendicular to its support plate. The spring pulls the spacer unit toward the holder so that a portion of the elongated body drops into lock notch 64, thereby locking the spacer unit in an attitude wherein the spacer unit is perpendicular to its supporting plate and the abutting head is placed adjacent to the adjacent surface of the adjacent plate against a stiffener, as shown in FIG. 5. Once the spacers are in position, electrodes 20 are then hung in their respective positions.

From the foregoing, it may be seen that the present construction allows the precipitator plates to be fabricated at the point of fabrication and shipped with the spacers attached, but without any interference of the spacers with the shipping and handling of the plates. Furthermore, the plates may be installed in the precipitator in a conventional manner. Upon completion of installation of the plates, the spacers are readily and quickly positioned in their operative position.

Although a specific embodiment of the herein disclosed invention has been shown and described in detail above, it is readily apparent that those skilled in the art may make various modifications and changes without departing from the spirit and scope of the present invention. It is to be expressly understood that the instant invention is limited only by the appended claims.

I claim:

1. In an electrostatic precipitator for collecting solid particles carried by a flue gas from a source of combustion, said precipitator including; a plurality of spaced parallel plates for collecting solid particles by electrostatic attraction of solid particles to the plates, a second plurality of elongated electrodes mounted between adjacent plates, the improvement comprising; a third plurality of spacers pivotally mounted on the plates, each of said spacers being selectively positionable substantially parallel to its respective plate, each of said spacers being selectively positionable to an attitude substantially perpendicular to its respective plate, each of said spacers extending from its respective plate to the adjacent plate to maintain adjacent surfaces of adjacent plates equidistantly spaced from one another, and a lock cooperative with each spacer, each lock being positioned on the respective plate upon which each spacer is pivotally mounted for holding the respective spacer in an attitude substantially perpendicular to the respective plate.

2. In an electrostatic precipitator for collecting solid particles carried by a flue gas from a source of combustion as defined in claim 1, wherein each of said spacers includes a head adapted for engagement with an adjacent surface of a plate adjacent to the respective plate upon which the spacer is pivotally mounted.

3. In an electrostatic precipitator for collecting solid particles carried by a flue gas from a source of combustion as defined in claim 1, including; a holder rotatably receiving the spacer, said holder being fixed to the respective plate supporting the spacer.

4. In an electrostatic precipitator for collecting solid particles carried by a flue gas from a source of combustion as defined in claim 1, wherein each of said plates has a fourth plurality of spatially arranged stiffeners projecting outwardly from opposite surfaces of each of the plates, and a holder rotatably supporting each of the spacers, each of the holders being fixed to the plate suoporting the spacer adjacent to a stiffener, each of said locks including a notch in the holder for receiving a portion of the spacer to hold the spacer substantially perpendicular to the supporting plate.

5. In an electrostatic precipitator for collecting solid particles carried by a flue gas from a source of combustion as defined in claim 1, including a holder pivotally supporting each of the spacers, each of the holders being fixed to the respective supporting plate, each of said locks including a notch in the holder for receiving the spacer and resilient means urging the spacer into the notch.

6. In an electrostatic precipitator for collecting solid particles carried by a flue gas from a source of combustion as defined in claim 1, including; a holder pivotally receiving each spacer, each holder being fixed to the respective supporting plate for the spacer, each spacer having a pivot portion pivotally mounted in the holder, said lock including a notch for receiving a portion of the spacer to hold the spacer substantially perpendicular to its respective support plate, and a spring connected to the pivot portion of the spacer and to the holder for resiliently urging the spacer into the notch.

7. In an electrostatic precipitator for collecting solid particles carried by a flue gas from a source of combustion as defined in claim 1, wherein each of said plates has a fourth plurality of spatially arranged stiffeners projecting outwardly from opposite surfaces of the plate, a holder pivotally supporting each of said spacers, each of said holders being positioned adjacent to a respective stiffener of the respective support plate to hold the spacer with the axis of pivoting of the spacer substantially parallel to the respective stiffener.

8. In an electrostatic precipitator for collecting solid particles carried by a flue gas from a source of combustion as defined in claim 1 including; a holder rotatably receiving the spacer, said holder being fixed to the respective support plate of the spacer, each of said spacers including a head adapted for engagement with an adjacent surface of a plate adjacent to the respective support plate upon which the spacer is pivotally mounted.

9. In an electrostatic precipitator for collecting solid particles carried by a flue gas from a source of combustion as defined in claim 1, wherein each of said plates has a fourth plurality of aligned stiffeners projecting outwardly from opposite surfaces of the plates, and a holder rotatably supporting each of the spacers, each of the holders being fixed to the respective support plate adjacent to a stiffener, each of said locks including a notch in the holder for receiving a portion of the spacer to hold the spacer substantially perpendicular to the respective support plate, each of said spacers including a head adapted for engagement with an adjacent surface of a plate adjacent to the respective support plate upon which the spacer is pivotally mounted.

10. In an electrostatic precipitator for collecting solid particles carried by a flue gas from a source of combustion as defined in claim 1, including; a holder pivotally supporting each of the spacers, each of the holders including a notch in the holder for receiving the support, resilient means urging the spacer toward the notch, each of the spacers includes a head adapted for engagement with an adjacent surface of a plate adjacent to the respective plate upon which the spacer is pivotally mounted.

11. In an electrostatic precipitator for collecting solid particles carried by a flue gas from a source of combustion as defined in claim 1, including; a holder pivotally receiving each spacer, each holder being fixed to the respective support plate of the spacer, each spacer having a pivot portion mounted in the holder, said lock including a notch for receiving a portion of the spacer to hold the spacer substantially perpendicular to its respective support plate and a spring connected to the pivot portion of the spacer and the holder for resiliently urging the spacer into the notch, and each of said spacers including a head adapted for engagement with an adjacent surface of a plate adjacent to the respective plate.

12. In an electrostatic precipitator for collecting solid particles carried by a flue gas from a source of combustion as defined in claim 1, wherein each of said plates has a fourth plurality of spatially arranged stiffeners projecting outwardly from opposite surfaces of the plate, a holder pivotally supporting each of said spacers, each of said holders being positioned adjacent to a respective stiffener of the respective plate to hold the spacer with the axis of pivoting of the spacer substantially parallel to the respective stiffener, and each of said spacers including a head adapted for engagement with an adjacent surface of a plate adjacent to the respective plate upon which the spacer is pivotally mounted.

13. In an electrostatic precipitator for collecting solid particles carried by a flue gas from a source of combustion as defined in claim 1, including; a holder rotatably receiving each spacer, each holder being fixed to the respective support plate, each of said plates has a fourth plurality of spatially arranged stiffeners projecting outward from opposite surfaces of each of the plates, each of the holders being fixed to the respective plate adjacent to a stiffener, and each of said locks including a notch in the holder for receiving a portion of the spacer to hold the spacer substantially perpendicular to the respective support plate.

14. In an electrostatic precipitator for collecting solid particles carried by a flue gas from a source of combustion as defined in claim 1, including; a holder rotatably receiving each spacer, each holder being fixed to the respective support plate of the spacer, and each of said locks including a notch in the holder for receiving the spacer and resilient means urging the spacer into the notch.

15. In an electrostatic precipitator for collecting solid particles carried by a flue gas from a source of combustion as defined in claim 1, including; a holder rotatably receiving each spacer, each holder being fixed to the respective support plate of the spacer, each spacer having a pivot portion mounted in the holder and being rotatable about an axis substantially perpendicular to the horizontal, each spacer having a pivot portion mounted in the respective holder, and said lock including a notch for receiving a portion of the spacer to hold the spacer substantially perpendicular to its respective plate and a spring connected to the pivot portion of the spacer and the holder for resiliently urging the spacer into the notch.

16. In an electrostatic precipitator for collecting solid particles carried by a flue gas from a source of combustion as defined in claim 1, including; a holder pivotally supporting each of the spacers, each of the holders being fixed to the respective support plate, each of said locks including a notch in the holder for receiving the spacer and resilient means urging the spacer into the notch, and each of said plates has a fourth plurality of spatially arranged stiffeners projecting outwardly from each side of each plate.

17. In an electrostatic precipitator for collecting solid particles carried by a flue gas from a source of combustion as defined in claim 1, including; a holder pivotally receiving each spacer, each holder being fixed to the respective support plate, each spacer having a pivot portion mounted in the holder, said lock including a notch for receiving a portion of the spacer to hold the spacer substantially perpendicular to its respective support plate, each holder defining the axis of pivoting of its respective spacer substantially perpendicular to the horizontal, and a spring connected to the pivot portion of the spacer and the holder for resiliently urging the spacer into the notch.

18. In an electrostatic precipitator for collecting solid particles carried by a flue gas from a source of combustion as defined in claim 1, including; a holder pivotally supporting each of the spacers to pivot about an axis substantially perpendicular to the horizontal, each of the holders being fixed to the respective support plate, and each of said locks including a notch in the holder for receiving the spacer and a spring connected to the pivot portion of the spacer and the holder for resiliently urging the spacer into the notch.

19. In an electrostatic precipitator for collecting solid particles carried by a flue gas from a source of combustion as defined in claim 1, wherein each of said plates has a fourth plurality of spatially arranged stiffeners projecting outward from opposite surfaces of each of the plates and extending vertically relative to the horizontal, a holder pivotally supporting each of the spacers, each of said locks including a notch in the respective holder, each of the holders being fixed to the respective plate adjacent to a stiffener and holding the spacer with its axis of rotation substantially parallel to the stiffener, each of said notches in the holder holding the spacer substantially perpendicular to the respective support plate, each of said locks including resilient means urging the spacer into the notch, and each of said spacers including a head adapted for engagement with an adjacent surface of a plate adjacent to the respective plate upon which the spacer is pivotally mounted.

20. In an electrostatic precipitator for collecting solid particles carried by a flue gas from a source of combustion as defined in claim 1, including; a holder pivotally supporting each of the spacers to have its axis of rotation of each spacer substantially perpendicular to the horizontal, each of said plates has a fourth plurality of spatially arranged stiffeners projecting outward from opposite surfaces of each of the plates and being substantially parallel to the axis of rotation of the spacers, each of the holders being fixed to its respective support plate adjacent to a stiffener, each of said locks including a notch in the holder for receiving the spacer and resilient means urging the spacer into the notch, each of said spacers including a head adapted for engagement with an adjacent surface of a plate adjacent to the relative plate upon which the spacer is pivotally attached, and a spring connected to the pivot portion of the spacer and the holder for resiliently urging the spacer into the notch.

* * * * *